United States Patent [19]

Gross et al.

[11] 4,329,671

[45] May 11, 1982

[54] ALIGNMENT-INSENSITIVE SELF-CONVERGING IN-LINE COLOR DISPLAY

[75] Inventors: Josef Gross, Princeton; William H. Barkow, Pennsauken, both of N.J.

[73] Assignee: RCA Corporation, New York, N.Y.

[21] Appl. No.: 253,292

[22] Filed: Apr. 13, 1981

Related U.S. Application Data

[63] Continuation of Ser. No. 70,311, Aug. 27, 1979, abandoned.

[51] Int. Cl.[3] ..... H01J 29/70

[52] U.S. Cl. ..... 335/213; 335/210

[58] Field of Search ..... 335/213, 210

[56] References Cited

U.S. PATENT DOCUMENTS

| | | | |
|---|---|---|---|
| 3,721,930 | 3/1973 | Barkow et al. | 335/210 X |
| 3,735,193 | 5/1973 | Ikeuchi | 335/213 X |
| 3,789,258 | 1/1974 | Barbin | 335/213 X |
| 3,800,176 | 3/1974 | Gross et al. | 315/13 C X |
| 3,942,067 | 3/1976 | Cawood | 315/13 C |
| 4,038,621 | 7/1977 | Chiodi et al. | 335/213 |
| 4,060,836 | 11/1977 | Corbeij et al. | 335/212 X |
| 4,096,462 | 6/1978 | Akatsu et al. | 335/213 |
| 4,117,434 | 9/1978 | Logan | 335/213 |
| 4,231,009 | 10/1980 | Barkow | 335/210 X |

OTHER PUBLICATIONS

"Errors of Magnetic Deflection, II" by J. Haantjes et al, Philips Res. Reports 14, pp. 65–97, 1959.

"Errors of Magnetic Deflection, I" by J. Haantjes et al, Philips Res. Rep. 12, pp. 46–68, 1957.

"High-Performance Power-Saving Color Picture Tube" by Hirofumi Suzuki et al, Hitachi Review, vol. 27, 1978, No. 4.

"Calculation of Magnetic Field Produced by Distributed Current on Revolving Surfaces" by T. Nomura, Electrical Engineering in Japan, vol. 91, No. 1, 1971, Translated from Denki Gakkai Zashi, vol. 91, No. 2, 2/71, pp. 319–327, pp. 147–155.

"The Calculation of the Deflection Magnetic Field and the Electron-Beam, Trajectory for Color Television" by Yokota et al, of Sanyo Electric Co., IEEE Transactions on Consumer Electronics, vol. CE—25, Feb. 1979, pp. 91–99.

*Primary Examiner*—Malcolm F. Hubler

*Attorney, Agent, or Firm*—Eugene M. Whitacre; Paul J. Rasmussen; William H. Meise

[57] ABSTRACT

A television display arrangement includes a kinescope comprising a viewing screen, an in-line electron beam gun assembly for producing a plurality of electron beams and an envelope defining a neck, at one end of which the electron gun assembly is mounted. A deflection yoke is associated with the kinescope for producing astigmatic deflection fields for substantially converging the beams at all points on the viewing screen. The astigmatic fields have balanced nonuniformity functions with low peak excursions for reducing the sensitivity of the beam convergence to the position of the yoke relative to the electron beams, by which relative movement between the yoke and the kinescope does not substantially affect the convergence.

2 Claims, 14 Drawing Figures a.
b.
c.
d.
e.
f.
HORIZONTAL
VERTICAL
θ=110°
θ=126°
θ=155°
θ=132°
θ=107°
θ=67°
35°
27°
12.5°
24°
70°
53°
58°
68°
50°
33°
7°
6.6°
29.9°
53.5°
33.5°
300
302
304
306
310
312
324
332
334
342
344
352
354

ALIGNMENT-INSENSITIVE SELF-CONVERGING IN-LINE COLOR DISPLAY

This is a continuation of application Ser. No. 070,311, filed Aug. 27, 1979, now abandoned.

BACKGROUND OF THE INVENTION

This invention relates to self-converging color picture tube or kinescope display systems that do not require precise transverse, or tilt, alignment between the deflection yoke and the electron beams of the kinescope.

Color television kinescopes or picture tubes create color images by causing electrons to impinge upon phosphors having different-wavelength emissions. Normally, phosphors having red, green and blue-light emission are used, grouped into trios or triads of phosphor areas, with each triad containing one phosphor area of each of the three colors.

In the kinescope, the phosphors of each of the three colors are excited by an electron beam which is intended to impinge upon phosphors emitting only one color. Thus, each electron beam may be identified by the color emitted by the phosphor which the beam is intended to excite. The area impinged on by each electron beam is relatively large compared with a phosphor triad, and at any position on the screen, each beam excites a particular color phosphor in each of several triads. The three electron beams are generated by three electron guns located in a neck portion of the kinescope opposite the viewing screen formed by the phosphors. The electron guns are oriented so that the undeflected beams leave the gun assembly in converging paths directed towards the viewing screen. For the viewing screen to display a faithful color reproduction of a scene it is necessary that the beam position relative to the kinescope be adjusted for producing color purity and static beam convergence at the center of the screen. The purity adjustment involves causing each of the red, green and blue beams to excite only its respective phosphor. This is accomplished by the shadow mask. The shadow mask is a screen or grill having large numbers of perforations through which the electron beams may pass. Each perforation is in a fixed position relative to each triad of color phosphor areas. The electron beams pass through one or more of the perforations and fall upon the appropriate color phosphors based upon their directions of incidence. Color purity depends upon a high order of accuracy in the placement of the phosphor triads relative to the perforations and the apparent source of the electron beams.

Static convergence involves causing the three beams to converge at one scanning spot at or near the center of the viewing screen. Convergence at the center of the screen may be accomplished by the use of a static convergence assembly mounted relative to the neck of the kinescope and adjusted or magnetized to produce a static magnetic field which causes the three beams to converge at the center of the viewing screen.

In order to form a two-dimensional image, the luminescent spot excited on the viewing screen by the three converged electron beams must be scanned both horizontally and vertically over the viewing screen to form a luminescent raster area. This is accomplished by means of magnetic fields produced by a deflection yoke mounted upon the neck of the kinescope. The deflection yoke deflects the electron beams with substantially independent horizontal and vertical deflection systems. Horizontal deflection of the electron beams is provided by coils of the yoke which produce a magnetic field having mainly vertically-directed field lines. The magnetic field intensity is varied with time at a relatively high rate. Vertical deflection of the electron beams is accomplished by coils producing mainly a horizontally-directed magnetic field which varies with time at a relatively low rate. A permeable magnetic core is associated with the yoke coils. The conductors of the coils may enclose the core to form a toroidal deflection winding, or the conductors may form saddle coils which do not enclose the core.

The kinescope viewing screen is relatively flat. The electrons of each electron beam will traverse a greater distance when deflected towards the edge of the viewing screen than when directed toward the center. Due to the separation of the electron guns, this may result in a separation of the landing points of the three electron beams when near or deflected towards the edge of the screen. In addition, prior art almost-uniform magnetic deflection fields caused the electron beams to be overconverged when deflected away from the center of the screen. These effects combine to cause the light spots of the three beams at points on the viewing screen away from the center to be separated. This is known as misconvergence and results in color fringes about the edges of the displayed images. A certain amount of misconvergence is tolerable, but complete separation of the three illuminated spots is generally not acceptable. Misconvergence may be measured as a separation of the ideally superimposed red, green and blue lines of a crosshatch pattern of lines appearing on the screen when an appropriate test signal is applied to the picture tube. Each of the three electron beams scans a raster, which may be identified by its color. Thus, a green raster is ordinarily scanned by the center electron beam, and the outside beams scan red and blue rasters. The crosshatch pattern is formed in each of the red, green and blue rasters. The crosshatch pattern outlines the raster with vertical and horizontal lines, and also includes other vertically and horizontally-directed lines, some of which pass through the center of the raster.

Formerly, kinescopes had the electron guns in a triangular or delta configuration. Convergence of the electron beams at points away from the center of the viewing screen was accomplished in delta-gun systems by dynamic convergence arrangements including additional convergence coils mounted about the neck of the kinescope and driven at the deflection rates by dynamic convergence circuits to excite pole pieces located within the neck of the kinescope to thereby impart corrective motion to the beams, as described in U.S. Pat. No. 3,942,067 issued Mar. 2, 1976 to Cawood.

As described in U.S. Pat. No. 3,789,258 issued Jan. 29, 1974 to Barbin, and in U.S. Pat. No. 3,800,176 issued Mar. 26, 1974 to Gross, et al., current television display arrangements utilize an in-line electron gun assembly together with a deflection yoke arrangement including deflection windings for producing negative horizontal isotropic astigmatism and positive vertical isotropic astigmatism such that the beams are substantially converged at all points on the raster. This eliminates the need for dynamic convergence apparatus in the colro TV display system. However, the nonuniform magnetic fields providing the isotropic astigmatisms necessary for self-convergence make the convergence dependent upon the position of the longitudinal axis of the yoke relative to the longitudinal axis of the undeflected beams. This sensitivity and the normal manufacturing tolerances affecting beam position in the tube, make it necessary to adjust the yoke transversely to achieve the best compromise convergence. A description of the magnitude of the convergence change resulting from a change of the position of the beams relative to the yoke axis appears in the aforementioned Barbin patent.

In order to provide clearance to allow the deflection yoke to be moved transversely (or tilted, which is accomplished by a transverse positioning of the free end of the yoke) relative to the electron beams in order to provide the best overall convergence over the surface of the screen, the diameter of the inner contour of prior-art deflection yokes is made larger than that of the corresponding contour of the envelope of the kinescope by a small amount, such as between 2 and 6 mm.

It is desirable to reduce, insofar as possible, the amount of materials used in the construction of deflection yokes. In order to accomplish this, the deflection yoke should be designed to closely hug the neck portion of the kinescope. Due to manufacturing tolerances, the inner design contour of the deflection yoke must be larger than the nominal outer contour of the kinescope neck, such that the worst-case smallest inner diameter of the yoke will fit snugly over the worst-case maximum outer diameter of the neck. In such a design, the deflection yoke is considered as fitting substantially snugly over the neck of a kinescope even though a gap may occur between the average inner diameter of the yoke and the average diameter of the neck.

Such a snug-fitting yoke will have substantially all of the magnetic flux generated by the coils within the neck of the kinescope. A deflection yoke which does not fit snugly, on the other hand, has magnetic flux in the interstice between the yoke and the kinescope neck. Flux outside of the neck is not used for deflection and merely adds to the total energy which must be stored in the yoke field in order to accomplish a given amount of deflection. Since the stored energy must be periodically added to and removed from the deflection yoke, increased reactive scanning power is required and yoke losses correspondingly increase for yokes which do not fit snugly about the neck of the kinescope. A deflection yoke which fits snugly about the neck of the kinescope may, therefore, be driven by deflection circuits which supply less reactive power, and will dissipate less yoke power. The resulting display system may be expected to have higher deflection sensitivity and be more reliable than displays with loose-fitting yokes. The position-sensitivity of the self-converging deflection windings heretofore used required that the deflection yoke be adjusted by a transverse motion as described in order to accomplish the desired convergence and consequently it has not been possible to provide a mass-produced self-converging yoke fitting snugly about the neck of a kinescope.

Prior art convergence adjustments by positioning the self-converging yoke relative to the beams have been made in various ways. As described in the aforementioned Barbin patent, a kinescope may first be fitted with the deflection yoke with which it is to be used. Static convergence adjustments are then made, the yoke is then moved transversely in vertical and/or horizontal directions to achieve best possible convergence and is then fixed in position by means such as glue or a suitable fastening arrangement. Such a yoke may at the time of its manufacture have been tested in conjunction with a standard kinescope to verify that its characteristics fall within a certain tolerance, i.e., that it is not defective. In a color TV display system currently produced by a major manufacturer, the Barbin technique is used in a two-step fashion. In this system, the picture tube incorporates features by which it can be individually adjusted with a standard deflection yoke during the last stage of manufacture, and yoke locating means are set in position on the tube based upon this adjustment. This system also uses a pre-aligned deflection yoke having mating locating means. In addition, an adjustable circuit associated with the yoke permits electrical compensation for the effects of any remaining horizontal misalignment of the beams in the vertical deflection field. Since every tube and every deflection unit is thus individually pre-aligned, any tube automatically matches with any deflection unit and presumably, the deflection unit only has to be pushed onto the neck of the tube until it seats and requires no further adjustment by the ultimate user.

It is desirable to eliminate this costly pre-alignment of each individual tube for the standard yoke. It is also desirable to provide a self-converging in-line gun television display system which achieves substantial convergence of three beams over the whole raster without the need for transverse or tilt adjustment of the yoke relative to the undeflected electron beams in the kinescope. A self-converging deflection yoke according to an embodiment of the invention not only requires no transverse alignment or pre-alignment for best convergence, but is incapable of being aligned for self-convergence because motion of the yoke relative to the kinescope does not substantially affect convergence. Heretofore, this result has been regarded as self-contradictory, for it was believed that the non-uniform deflection fields necessary to achieve self-convergence by differential deflection of the electron beams made the convergence dependent upon precise alignment of the yoke field with the longitudinal axis of the undeflected electron beams. For example, U.S. Pat. No. 4,060,836 issued Nov. 29, 1977 to Corbeij, et al., states that coincidence of the axes of the deflection field and the display tube is a condition to achieving convergence without additional aids. As a result of the lack of convergence sensitivity, the self-converging yoke in one embodiment of the invention may fit snugly about the neck of the kinescope.

Incremental sensitivity of convergence to vertical and horizontal motion of the yoke about its centered position relative to the beams can be measured to yield a dimensionless ratio of convergence error of the outer beams divided by yoke motion. Ordinarily, convergence error is measured in millimeters, so the ratio represents mm error/mm yoke motion. Yoke motion in a single plane may result in a convergence error at the ends of both directions of deflection. For example, horizontal motion of the yoke from that positon which yields best convergence may cause a change or error in the width of the red raster relative to the blue as well as a relative change or error in height of these two rasters. In particular, horizontal displacement of the beams in the yoke field causes the raster scanned by the leading beam, i.e., the beam which is offset in the direction of displacement, to scan a raster which is increased in width and height relative to that scanned by the lagging beam. Similarly, a vertical motion of the yoke relative to the kinescope may cause an apparent relative rotation or crossover of the central horizontal as well as vertical crosshatch lines displayed on the raster. In particular, a displacement of the beams upward in the yoke field causes the central crosshatch lines scanned by the right-hand offset beam (as viewed from the screen or exit end of the yoke) to rotate clockwise, and those scanned by the left-hand beam to rotate counterclockwise. Vertical movement downward reverses the directions of rotation. Measurements have been made of the incremental sensitivity of convergence to motion of a number of recent display systems including deflection yokes. The results in mm/mm are summarized and tabulated as follows:

| | HORIZ. MOTION | | VERT. MOTION | |
|---|---|---|---|---|
| System | Width Error | Height Error | Horiz. Crossover | Vert. Crossover |
| Hitachi 17V 90° semitoroidal | 0.2 | 0.8 | 0.5 | 0.7 |
| Philips 20AX 25V 110° saddle | 0.5 | 0.3 | 0.5 | 0.3 |
| Philips 30AX 25V 110° saddle | 0.9 | 1.0 | 0.6 | 0.1 |
| Some RCA systems not embodying the present invention gave the following results: | | | | |
| XD4780 19V 90° full toroidal | 1.7 | 0.8 | 1.2 | 0.6 |
| XD5000 13V 90° semitoroidal | 0.6 | 0.7 | 0.5 | 0.5 |
| XP74-125Q 25V 110° full toroidal | 2.8 | 1.2 | 1.6 | 0.3 |

The 20AX and XP74–125Q systems exhibit relatively low vertical crossover errors because both the 20AX and XP74–125Q display systems are not completely self-converging but use dynamic convergence for top-bottom convergence. The reduced height error in response to horizontal motion of the yoke and reduced vertical crossover error in response to vertical motion result from the reduced vertical astigmatism made possible by the use of dynamic convergence in the 20AX display system.

A mathematical description of the dimensioning of a self-converging yoke is provided by third-order aberration theory as follows. Third-order aberration theory of magnetic deflection can be used to analyze the approximate electron-optical performance of a yoke from its field distribution functions $H_0(z)$ and $H_2(z)$ which vary with the position along the longitudinal or z axis of the yoke as is described in two articles entitled "Errors of Magnetic Deflection" by J. Haantjes and G. J. Lubben (H&L) which respectively appeared in Philips Research Reports, Vol. 12, pp. 46–48, 1957 and in Vol. 14, pp. 65–97, 1959. The system of notation adopted herein follows that of H&L.

The deflection of the electron beams taking into account only $H_0(z)$, the main component of the deflecting field, is termed Gaussian and is designated X or Y. A more complete representation of the field includes $H_2(z)$, which represents the transverse nonuniformity of the yoke field.

While the description of a yoke field by the field distribution functions $H_0(z)$ and $H_2(z)$ is not rigorously applicable to total deflection angles greater than 75°, the trends indicated by this field description are useful in outlining performance of mangetic deflection systems with wider total deflection angles, such as 90° and 110°.

The deflection fields are described by a power-series expansion about the electron-optical axis of the yoke in such a manner that in the horizontal plane (y=0) the horizontal deflection field is:

$$H_{IIy}=H_{II0}(z)+H_{II2}(z)x^2+\ldots \quad (1)$$

where the yoke axis lies along the z-axis of the coordinate system, and the vertical deflection field in the vertical plane (x=0) is:

$$H_{Ix}=H_{I0}(z)+H_{I2}(z)y^2+\ldots \quad (2)$$

The subscript I refers to a magnetic field having its main component in the x-direction i.e., the vertical deflection field, and subscript II refers to a field having its main component in the y-direction i.e., the horizontal deflection field.

The general aberration expressions describe the differences $\Delta x$ and $\Delta y$ at the viewing screen between the Gaussian deflection and the third-order deflection (i.e., with $H_2$ (z) taken into account). These expressions for $\Delta x$ and $\Delta y$ are simplified in the case of a kinescope with in-line electron beams by eliminating terms relating to entrance of the beams into the yoke field with slopes other than in the horizontal plane.

For in-line electron beams, the aberration expressions pertinent to the invention are:

$$\Delta x = \underbrace{(A_4X_s^2 + B_5Y_s^2)(x_s')}_{\text{(astigmatism)}} + \underbrace{A_7X_s(x_s')^2}_{\text{(coma)}} + \underbrace{A_{16}X_sx_s'x_s + B_{17}Y_sx_s'y_s}_{\text{(alignment sensitivity of convergence)}} \quad (3)$$

$$\Delta y = \underbrace{(B_2 + A_3)X_s^2Y_s}_{\text{(NS pin-cushion)}} + \underbrace{(A_6 + B_6)X_sY_sx_s'}_{\text{(astigmatism)}} + \underbrace{B_8Y_s(x_s')^2}_{\text{(coma)}} + \underbrace{B_{18}Y_sx_s'x_s + A_{18}X_sx_s'y_s}_{\text{(alignment sensitivity of convergence)}} \quad (4)$$

Here, $X_s$ and $Y_s$ are the Gaussian deflections at the screen, $x_s'$ is the slope in the horizontal plane of the beam entering the yoke field and $x_s$, $y_s$ are the coordinates or the landing point of the undeflected beam measured from the trace of the yoke axis on the screen. Equations (3) and (4) are partial, in that only terms relating to the invention, i.e., North-South (NS) pincushion, convergence (astigmatism and coma), and alignment sensitivity of convergence have been included. The aberration coefficients $A_1$–$A_{18}$ and $B_1$–$B_{18}$ can be expressed in integral form. The physical significance of the aberration coefficient becomes clear when the following simplifying assumptions are made; (a) the main deflecting fields of the vertical and horizontal coils are similar, i.e., $H_{II0}$ (z)$\approx -CH_{I0}$ (z); and (b) their Gaussian deflections are substantially coincident so that $X \approx CY$ (a scale factor difference $C \neq 1$ does not affect the aberration coefficients, which include ratios of the field distribution functions). These are excellent approximations for toroidal yokes, in which the vertical and horizontal windings have the same axial length; and in the case of saddle or saddle-toroid windings, the shorter length of the vertical coils is compensated by their larger inner diameter so the approximations remain valid. The detailed winding distributions of the horizontal and vertical coils are different, and as a result, their nonuniformity functions are dissimilar; $H_{II2}(z) \neq -CH_{I2}(z)$.

The simplified aberration coefficients necessary for understanding the invention are then:

$$B_2+A_3=(\lambda/4D^2)+2S_{II1}+S_{I1} \quad (5)$$

$$A_4=\frac{3}{2D}\left[1-\frac{\lambda}{6}\right]-2S_{II2} \quad (6)$$

$$B_5=\frac{1}{L}\left[1+\frac{\lambda^2}{6}\right]-\frac{1}{2D}+2S_{I2} \quad (7)$$

$$A_6+B_6=(\lambda/3D)+2(S_{II2}+S_{I2}) \quad (8)$$

$$A_7=(3/2)-S_{II3} \quad (9)$$

$$B_8=-\tfrac{1}{2}+S_{I3} \quad (10)$$

$$A_{16}=-2S_{II4} \quad (11)$$

$$A_{18}=2S_{II4}-(1/D) \quad (12)$$

$$B_{17}=2S_{I4} \quad (13)$$

$$B_{18}=2S_{I4}-(1/D) \quad (14)$$

in which D is the distance from the principal plane of Gaussian deflection to the screen, L is the effective length of the deflection yoke, $\lambda=L/D$, and $S_1$, $S_2$, $S_3$ and $S_4$ are defined below.

The terms $S_{IIi}$, $S_{Ii}$ (i=1,2,3,4) are integral expressions containing the functions $H_{II0}$, $H_{II2}$ and $H_{I0}$, $H_{I2}$. Thus, for example, North-South pincushion distortion is determined by the coefficient $B_2+A_3$ of equations (4) and (5), which includes both:

$$S_{II1}=(1/X_s^3)\int H_{II2}X^2(z-z_s)dz \quad (15)$$

and $$S_{I1}=(1/Y_s^3)\int H_{I2}Y^2(z-z_s)dz \quad (16)$$

Here, $X_s$ and $Y_s$ are the Gaussian deflections on a viewing screen located at $z_s$ with a distance $D=(z_s-z_c)$ from the deflection center $z_c$ of the yoke, and z is distance measured along the longitudinal axis of the yoke. $H_{II2}$ and $H_{I2}$ are the horizontal and vertical field nonuniformity functions respectively. The integration is formally performed from $-\infty$ to $+\infty$ but practically may be considered to begin at a distance approximately one yoke diameter from the entrance of the yoke and to terminate at the screen.

Astigmatism in the horizontal direction is determined by the coefficient $A_4$, which in turn is partially determined by:

$$S_{II2}=(1/X_s^2)\int H_{II2}X(z-z_s)^2dz \quad (17)$$

Astigmatism in the vertical direction is determined by the coefficient $B_5$, which in turn is partially determined by:

$$S_{I2}=(1/Y_s^2)\int H_{I2}Y(z-z_s)^2dz \quad (18)$$

Coma is determined by:

$$\text{(horizontal)} \quad S_{II3}=(1/X_s)\int H_{II2}(z-z_s)^3dz \quad (19)$$

$$\text{(vertical)} \quad S_{I3}=(1/Y_s)\int H_{I2}(z-z_s)^3dz \quad (20)$$

These expressions describe the pincushion, astigmatism and coma distortions considered in the prior art for producing self-converging yokes corrected for N-S pincushion and for coma.

Alignment sensitivity is determined by:

$$\text{(horizontal)} \quad S_{II4}=(1/X_s)\int H_{II2}(z-z_s)^2dz \quad (21)$$

$$\text{(vertical)} \quad S_{I4}=(1/Y_s)\int H_{I2}(z-z_s)^2dz \quad (22)$$

While all portions of the yoke and its fields affect each of the distortions, the effect of changes in particular regions of the fields may affect particular distortions disproportionately.

This invention is based on the recognition that different portions of the $H_2$-functions contribute differently to the sensitivity of convergence to misalignment of the yoke relative to the picture tube of the display system. Three yoke field regions are defined. The entrance region extends from the exit of the electron gun to the vicinity of the entrance plane of the horizontal coils. The exit region extends from the vicinity of the exit plane of the core to the screen. The mid region is bounded by the entrance and exit planes.

The weighting functions appearing in the integrands of $S_{IIi}$, $S_{Ii}$ weight the $H_2$-functions as shown in FIG. 1. Under the assumption of similar main deflecting fields, only the horizontal weighting functions need be shown since the weighting functions for the vertical field correspond. In FIG. 1, the abscissa represents axial distance in the display system measured from the deflection center $z_c$ and the ordinate represents the weighting function in arbitrary units. The screen is at a position $z_s=10$ inches (25.4 cm) from the deflection center. The approximate position of the entrance and exit planes of a deflection yoke are indicated as EN and EX, respectively. The ordinate values are not the same for the different functions.

Equations (15) and (16) indicate that pincushion is determined mainly by the behaviour of the $H_2$-functions in the exit region and, to a smaller extent, in the mid region since the magnitudes of the negative weighting functions appearing in these equations, $X^2(z-z_s)$ and $Y^2(z-z_s)$, rise very steeply from their low values at the entrance, as illustrated in FIG. 1.

Equations (17) and (18) indicate that the astigmatism required for self-convergence is determined by portions of the $H_2$-functions in the mid and exit regions of the yoke since the positive weighting functions $X(z-z_s)^2$ and $Y(z-z_s)^2$ rise rapidly from their values at the entrance.

Equations (19) and (20) indicate that coma is determined mainly by the behaviour of the $H_2$-functions in the entrance region and, to a smaller extent, in the mid region since the magnitude of the negative weighting function $(z-z_s)^3$ decreases rapidly from its maximum value at the entrance.

Equations (21) and (22) show that convergence sensitivity to misalignment is determined by the behaviour of the $H_2$-functions in the entrance and mid regions and, to a smaller extent, in the exit region, since the positive weighting function $(z-z_s)^2$ decreases less rapidly from its maximum value at the entrance.

Prior-art self-converging yokes for horizontal in-line gun display systems such as the RCA 19V90° toroidal yoke or the Hitachi 17V90° semitoroidal yoke, had field distribution functions as illustrated in FIGS. 2 and 3, respectively. As illustrated in FIGS. 2 and 3, the $H_{I2}$ and $H_{II2}$ functions are multiplied by a factor of 10 for clarity.

A qualitative discussion of prior art yokes can be based on the weighting functions illustrated in FIG. 1 in conjunction with FIGS. 2 and 3. These yokes had horizontal field nonuniformity functions $H_{II2}$ whose positive lobes (pincushion-shaped fields) exhibited excessively large peaks in proximity to the entrance (EN) of the yoke. Such $H_{II2}$-functions produced the negative astigmatism required for convergence of the offset beams along the horizontal axis in an inefficient manner, since pincushion fields located near the entrance of the yoke, where the deflection is still small, must have excessive nonuniformity to achieve self-convergence. This inefficient axial distribution of the $H_{II2}$-functions illustrated in FIGS. 2*a* and 3*a* led to sensitivity of convergence to misalignment of the beams in the horizontal fields and contributed to horizontal coma. The aforementioned prior-art yokes had vertical field nonuniformity functions $H_{I2}$ with excessively large negative values (barrel-shaped fields) near the entrance of the yoke, and in the case of toroidal vertical coils, as shown in FIGS. 2 and 3, all negative, unbalanced or single-lobe $H_{I2}$-functions. Such $H_{I2}$-functions produced the positive astigmatism required for self-convergence along the vertical axis inefficiently, since the contribution of barrel fields at the entrance of the yoke to astigmatism is small, thus forcing the mid-yoke barrel fields to have excessive nonuniformity for achieving self-convergence. The consequences of this inefficient axial distribution of the $H_{12}$-functions illustrated in FIGS. 2*b* and 3*b* were substantial vertical coma, high sensitivity of convergence to misalignment of the beams in the vertical fields, and a significant contribution to NS pincushion that was difficult to correct by the horizontal coils without causing "gullwing" or higher-than-horizontal-frequency distortion of the raster top and bottom.

SUMMARY OF THE INVENTION

A television display arrangement includes a kinescope having a viewing screen, an in-line electron gun assembly for producing a plurality of electron beams and an envelope defining a neck at one end of which an electron gun assembly is mounted. A deflection yoke is associated with the kinescope for producing astigmatic deflection fields for substantially converging the beams at all points on the viewing screen. The astigmatic fields each have minimized nonuniformity functions for reducing the sensitivity of the convergence to the position of the yoke relative to the electron beams, by which relative movement between the yoke and the kinescope does not affect the convergence.

DESCRIPTION OF THE INVENTION

Figure 1:
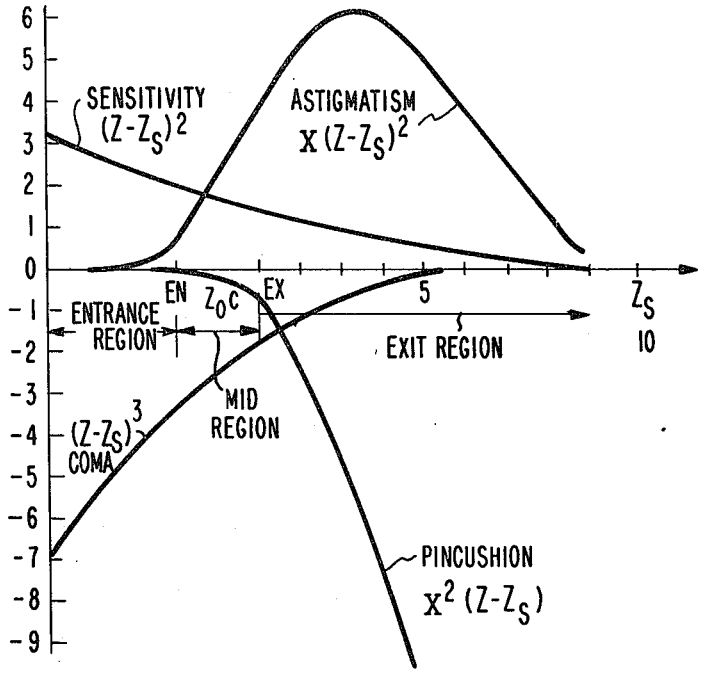
FIG. 1 illustrates plots of weighting functions useful in explaining the regions significant to the various deflection errors.
Figure 2A:
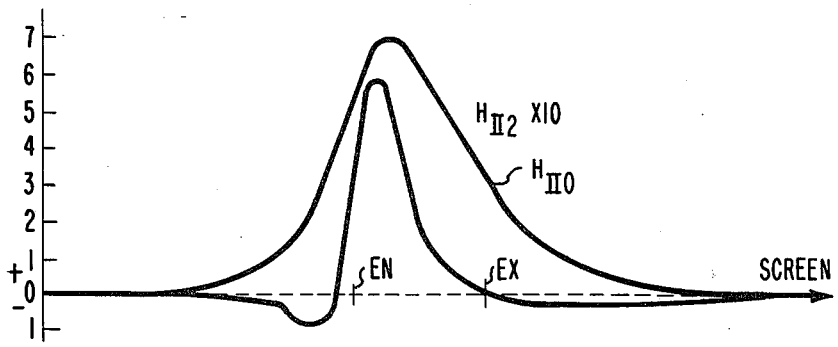
FIGS. 2*a*, 2*b*, 3*a* and 3*b* are plots describing the deflection field distribution in prior art yokes.
Figure 2B:
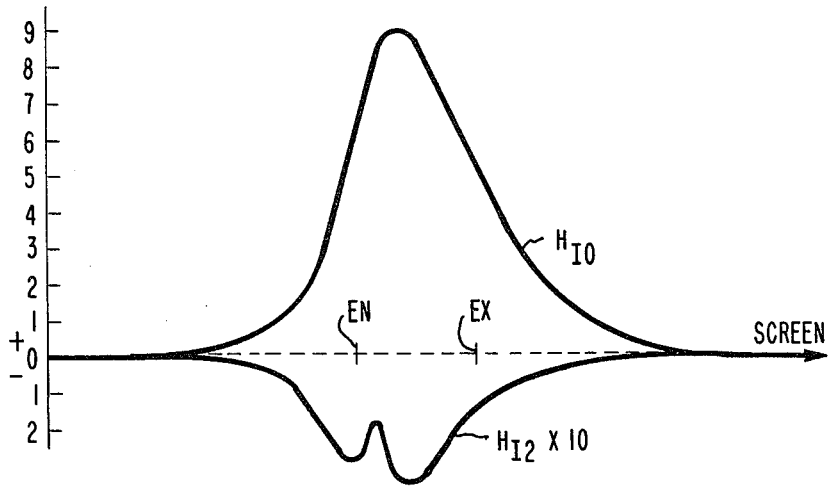
Figure 3A:
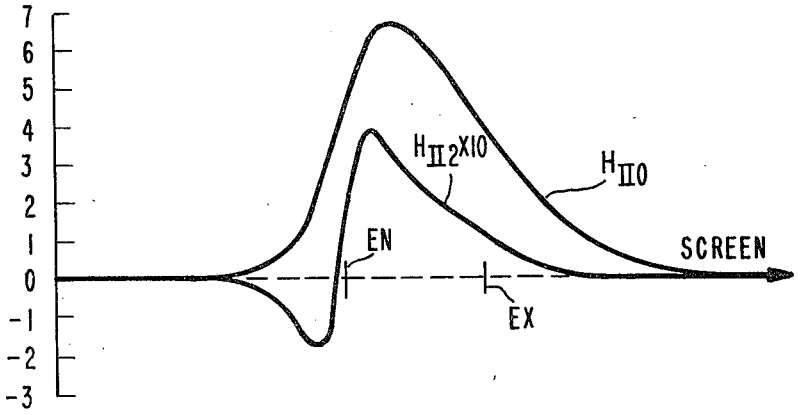
Figure 3B:
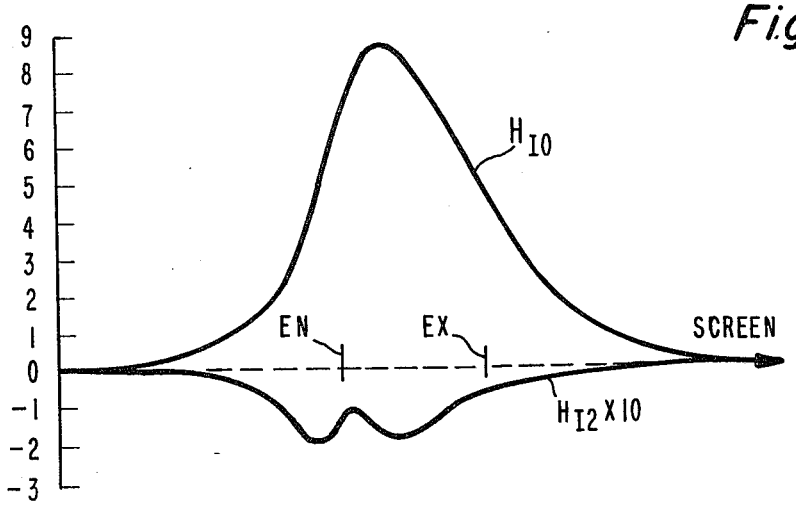

In accordance with the invention, yokes with non-geodesic windings, i.e., yokes having typical turns not lying on the shortest path between two points on the inner surface of the coils, can be made to achieve the astigmatism required for self-or simplified convergence together with reduced coma and reduced top and bottom pincushion distortion and the convergence of which is simultaneously insensitive to alignment errors between the yoke fields and the electron beams of the kinescope.

These yokes eliminate coma and minimize sensitivity of convergence to misalignment of the beams in the deflection fields by balancing the minimum mid and exit-region nonuniformities of the horizontal and vertical fields that are required for self-convergence and NS pincushion-correction with opposite nonuniformities at the entrance of the yoke. The horizontal $H_{II2}$-function has a smaller positive portion in the mid region of the yoke, and the peak value of the $H_{II2}$-function occurs further toward the exit end than in the prior art. The vertical $H_{I2}$-function includes a negative entrance lobe, a positive lobe immediately inside the entrance plane, and a mid-to-exit portion of smaller negative peak value than in the prior art, said negative peak occurring closer to the exit than in the prior art. This axial distribution of the $H_2$-functions is more efficient, because it generates the magnitudes of negative horizontal and positive vertical astigmatism necessary for self-convergence with smaller peak value of the nonuniformity functions of horizontal pincushion and vertical barrel fields. This more efficient distribution of field nonuniformity offers additional design freedom by comparison with prior art yokes, and this design freedom is exploited to minimize the sensitivity of convergence to misalignment of the beams in the yoke field, and to substantially eliminate horizontal and vertical coma and North-South pincushion distortion of the raster.

The nonuniformity functions of the fields generated by yokes embodying the invention are subject to four requirements which can be described mathematically. These requirements are as follows:

(1) According to the invention, North-South pincushion distortion is minimized by making:

$$S_{II1} = -\tfrac{1}{2}(S_{I1}) - (\lambda/8D^2) \tag{23}$$

(2) The magnitudes of the negative horizontal and positive vertical astigmatism required for self-convergence are achieved by making:

$$S_{II2} = (3/4D) \text{ to make } A_4 \approx 0 \tag{24}$$

$$S_{I2}=(1/4D)-(1/2L) \text{ to make } B_5\approx 0 \quad (25)$$

These conditions on $A_4=B_5\approx 0$ are also used here as approximations for the case of larger-screen displays, where $A_4$ is given a small positive, $B_5$ a small negative value in order to minimize $A_6+B_6$ (underconvergence along the horizontal, overconvergence along the vertical axis thereby achieving substantial convergence over the whole raster).

(3) Coma is eliminated by making:

$$S_{II3}=(3/2) \text{ for } A_7=0 \quad (26)$$

$$S_{I3}=\tfrac{1}{2} \text{ for } B_8=0 \quad (27)$$

(4) Elimination of convergence sensitivity to horizontal misalignment requires:

$$S_{II4}=0 \text{ for } A_{16}=0 \quad (28)$$

$$S_{I4}=(1/2D) \text{ for } B_{18}=0 \quad (29)$$

and elimination of convergence sensitivity to vertical misalignment requires:

$$S_{II4}=(1/2D) \text{ for } A_{18}=0 \text{ TM } (30)$$

$$S_{I4}=0 \text{ for } B_{17}=0 \quad (31)$$

Since $S_{I4}$ and $S_{II4}$ cannot simultaneously equal both $(1/2D)$ and 0, convergence sensitivity to both horizontal and vertical misalignment is minimized by making:

$$S_{II4}=S_{I4}=(1/4D) \quad (32)$$

The seven equations (23), (24), (25), (26), (27), and (32) are satisfied by the "minimum $-H_2$" fields generated by the new jokes. Assuming given $H_{IIo}=-CH_{Io}$ functions, these seven equations constitute a set of linear integral equations whose solutions are the minimum $-H_2$ functions produced by yokes according to the invention.

Figure 4A:
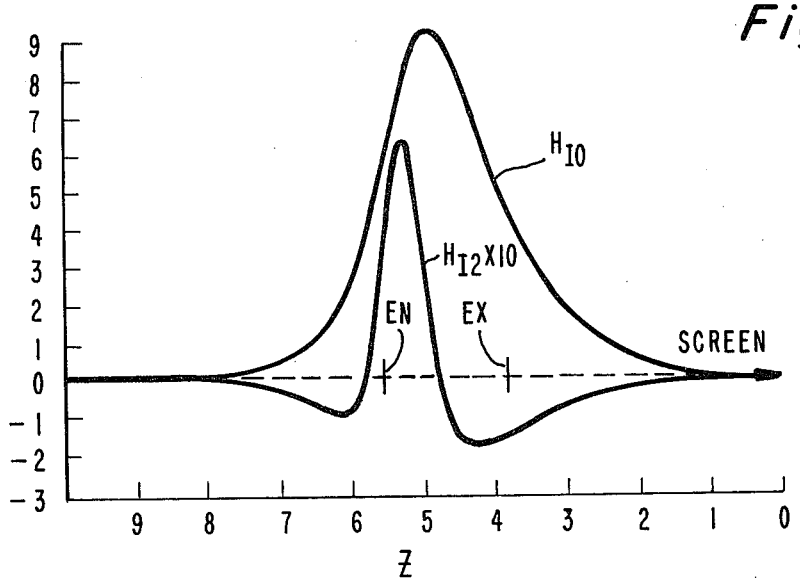
FIGS. 4*a* and 4*b* illustrates plots describing the deflection field distribution in a yoke according to the invention.
Figure 4B:
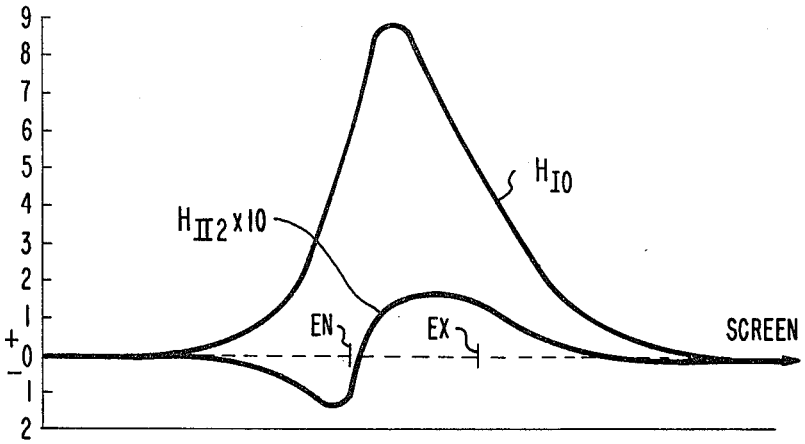

A plot of the $H_0$ and $H_2$ functions of a deflection yoke according to an embodiment of the invention is illustrated in FIG. 4. In yokes embodying the invention, the vertical coils contribute a smaller amount of NS pincushion than do prior-art yokes, since their barrel fields in the mid region of the yoke have smaller nonuniformity, as can be seen from FIG. 4*a*. This permits the horizontal coils with mid-yoke pincushion fields of smaller nonuniformity but extending over a larger region towards the screen as shown in FIG. 4*b* to correct NS pincushion. This smaller nonuniformity of both horizontal and vertical fields in the mid-to-exit regions permits achievement of self-convergence that is substantially insensitive to the position of the beams relative to the fields.

Figure 5:
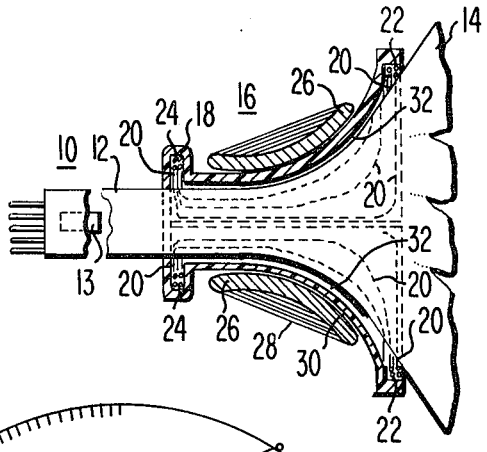
FIG. 5 illustrates an elevation cross-section of a kinescope and deflection yoke arrangement embodying the invention.

FIG. 5 illustrates generally a kinescope 10 and a deflection yoke 16. Kinescope 10 includes an envelope having a neck portion 12 merging into a flaring bulb portion 14. An electron gun assembly 13 represented as a block 13 mounted in neck 12 produces horizontal in-line electron beams in kinescope 10. Deflection yoke 16 is of the hybrid or saddle-toroid type and includes horizontal windings 20, the electron-beam exit-end turns of which are illustrated as 22. The beam-entrance end turns are illustrated as 24. Vertical deflection windings 28 are toroidally wound about a magnetic core 26. An insulator 18 interposed between horizontal windings 20 and toroidally wound vertical windings 28 supports the windings in position with respect to each other, and also provides means (not shown) by which the yoke assembly may be affixed to kinescope 10. In accordance with the invention, windings 20 and 28 are configured to provide substantial insensitivity of convergence in response to vertical or horizontal transverse motion or tilting motion of yoke 16 relative to kinescope 10. Consequently, the gap illustrated as 32 between yoke 16 and kinescope 10 does not have to be any larger than mechanical assembly tolerances require. As a result, no substantial vertical or horizontal transverse motion of yoke 16 relative to kinescope 10 is possible. Similarly, no substantial tilting motion is possible. With such an arrangement, the yoke closely hugs the neck of the tube and less materials may be required in its construction compared with the arrangement in which gap 32 is large. In an arrangement as in FIG. 5, more of the magnetic flux generated by the yoke is used for deflection than in the prior art. To achieve a given flux density within the neck of the kinescope for deflecting the electron beams, a smaller current is required than in the prior art and therefore the deflection sensitivity is increased and the circulation of energy between the yoke and the drive circuits is reduced, and the total power dissipated in deflection may be minimized.

As is known, only those conductors of the vertical and horizontal windings lying along the inner periphery of the magnetic core of a deflection yoke significantly affect the deflection. Consequently, the winding distribution providing the benefits of the invention may be achieved with either toroidal or saddle windings.

Figure 6A:
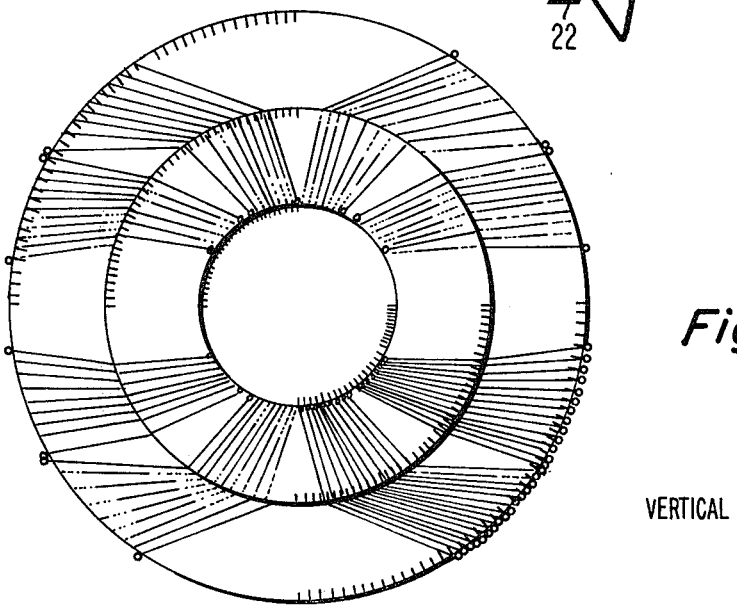
FIGS. 6*a* and 6*b* illustrate separate exit-end views of vertical and horizontal windings, respectively, of a yoke embodying the invention, which views are not to scale in order to enhance clarity.
Figure 6B:
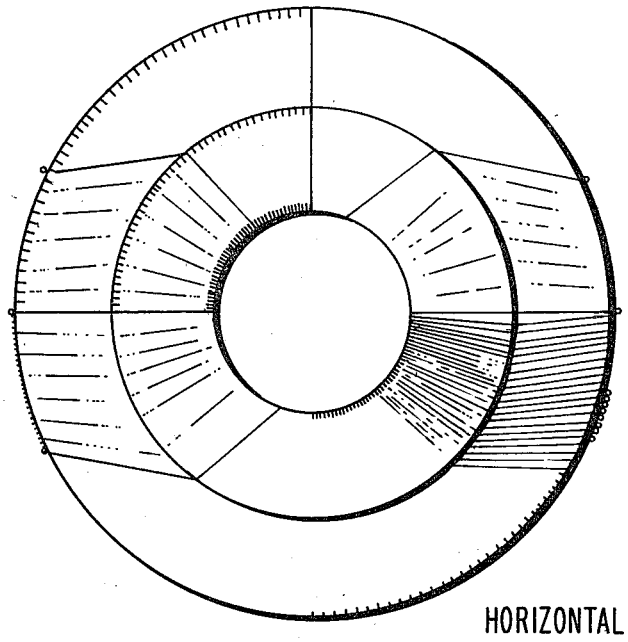

FIG. 6*a* illustrates a horizontal deflection winding distribution of a yoke embodying the invention, and FIG. 6*b* illustrates a vertical winding distribution thereof, as viewed from the large or beam-exit end of the deflection yoke. From these views, it is difficult to discern the distribution near the beam-entrance end, even though the entrance ring has been made large to enhance clarity.

FIGS. 7*a*–7*c* illustrate two quadrants of the turns distribution at the entrance, mid and exit ends or regions, respectively, of the horizontal windings of the yoke illustrated in FIG. 6. FIGS. 7*d*–7*f* illustrate two quadrants of the turns distribution of the vertical deflection windings at the entrance, mid and exit regions of the yoke of FIG. 6.

Figure 7:
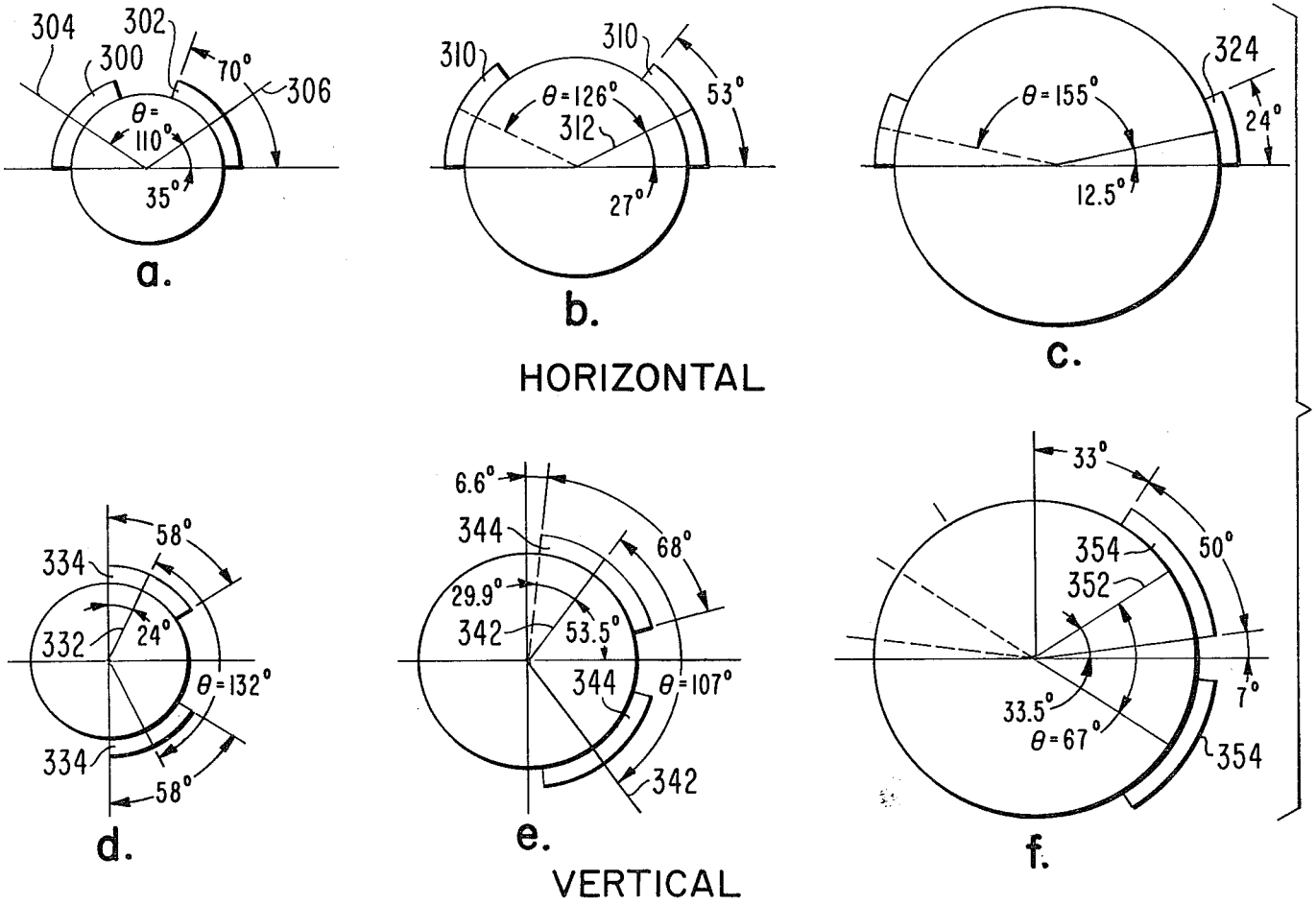
FIGS. 7*a*–7*f* illustrates in schematic form the winding distribution taken at three separate cross-sections of a yoke embodying the invention.

In FIG. 7*a*, the region marked 300 and 302 represents the region in which turns of winding near the entrance end of the yoke occur. The lines marked 304 and 306, respectively, represent the centroids of the actual winding distribution rather than the centroid of areas 300 and 302. As illustrated in FIG. 7*a*, winding distribution 302 subtends a central angle of 70°, and the centroids 304,306 of the winding distribution itself occur at an angle of 35° from the horizontal, thereby indicating that the actual winding distributions are symmetrically disposed about the centroids. Similarly, in FIG. 7*b* representing a cross-section near the mid region of the yoke, regions 310 represents the region in which horizontal windings occur. Each region 310 subtends a central angle of 53° and starts at the horizontal plane. Line 312, representing the angle of the centroid of a winding distribution occurring within a region 310, is elevated 27° from the horizontal plane, thereby showing that the winding distribution in region 310 is almost symmetrical. However, no indication is provided in such a representation to indicate whether the distribution is concentrated at the ends of region 310, distributed evenly throughout, or is some other distribution. Similarly, FIG. 7*c* illustrates a winding distribution near the exit region of the yoke occupying a region 324 which subtends a central angle of 24°, the centroid of which winding distribution is 12.5° above the horizontal. Obviously, the winding distribution contained in region 324 is not symmetrical, yet no indication of the actual distribution is given. FIG. 7*d* illustrates regions 334 in which the vertical winding distribution is located at a cross-section near the entrance end of the yoke. Regions 334 each subtend a central angle of 58°. The centroid of each winding distribution is located 24° from the vertical axis, which is not in the center of region 334. Similarly, FIG. 7*e* illustrates regions 344 in which the vertical winding distribution is located. Each region 344 begins 6.6° from the vertical axis and subtends an angle of 68°. The centroid of the winding distribution in each region 344 is located on a line 342 lying 36.5° from the vertical axis and which is not near the center of region 344. FIG. 7*f* illustrates a corresponding distribution 354 at the exit end of the yoke, the centroid 352 of which is near the center of the region 354 in which the winding distribution occurs. From FIG. 7, it will be clear that a more detailed description of the winding distribution is necessary to adequately describe their details.

Figure 8:
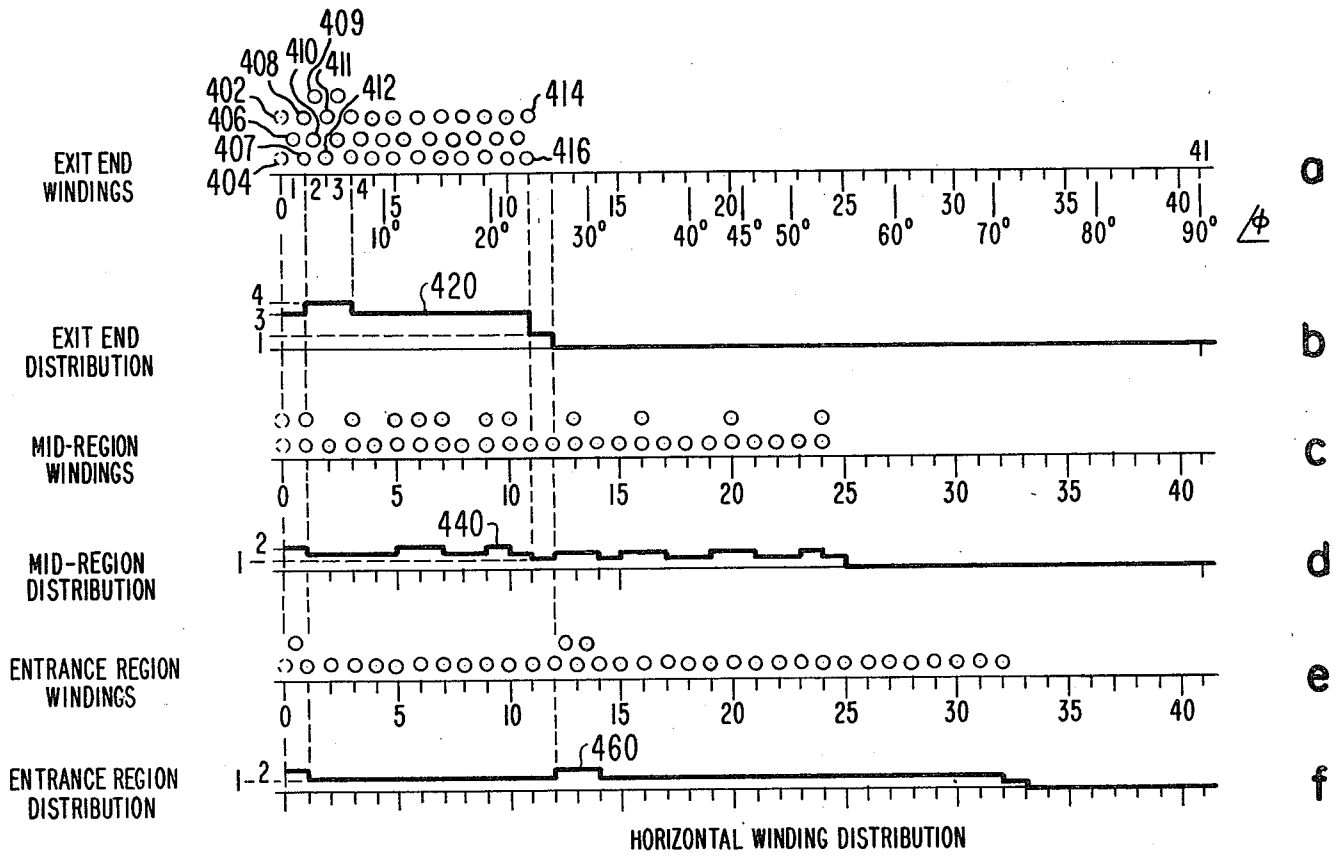
FIGS. 8*a*–8*m* is a preferred alternative representation of the winding distribution of a yoke embodying the invention, together with a more detailed representation of the turns distribution.
Figure 8:
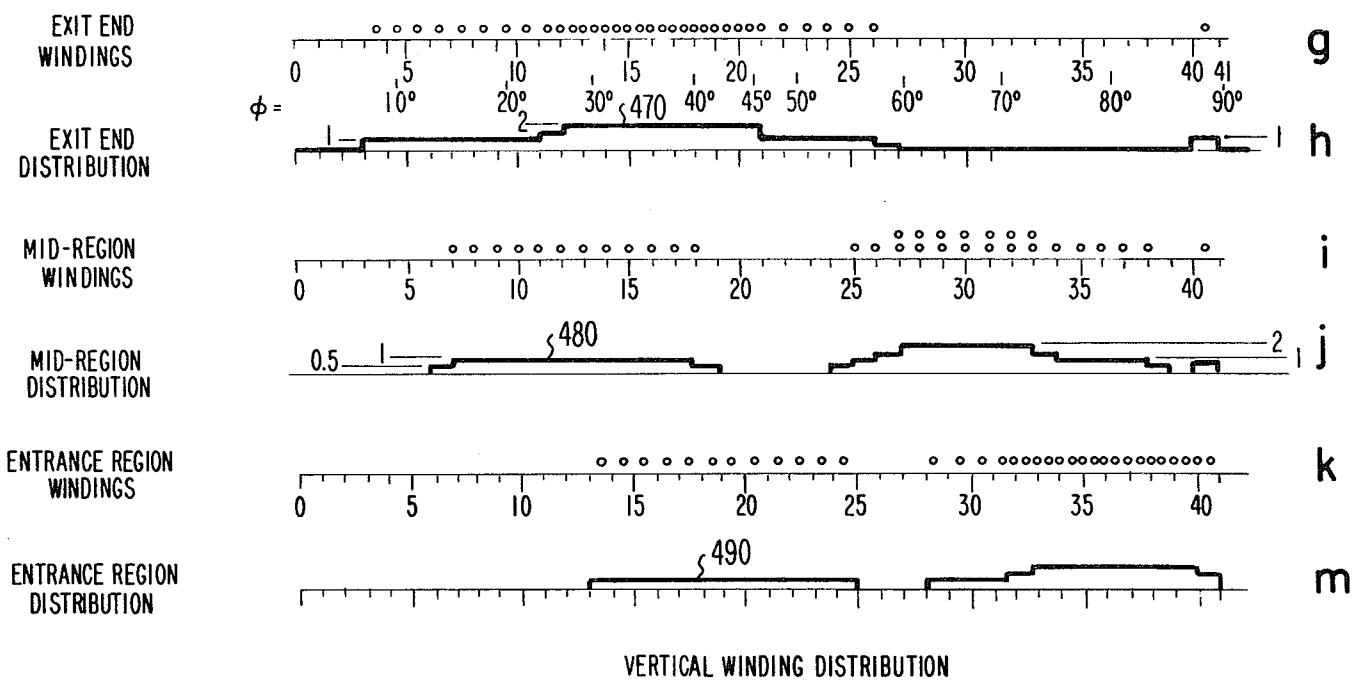

FIG. 8 includes two alternate representations of a winding distribution according to the invention. FIGS. 8*a*–8*f* describe the horizontal winding distribution, and FIGS. 8*g*–8*m* illustrate the vertical winding distribution of a yoke according to the invention. FIGS. 8*a*, 8*c*, 8*e*, 8*g*, 8*i* and 8*k* illustrate the actual conductor distribution, and FIGS. 8*b*, 8*d*, 8*f*, 8*n*, 8*j* and 8*m* represent turns density distribution $w_H$ and $w_V$ derived from the conductor distribution. The horizontal axes of the graphs in FIG. 8 represent one quadrant around the periphery of the yoke. The quadrant is divided into 41 equal portions each of which is numbered. These portions may represent actual channels into which the conductors or wires may be placed, or the portions may represent indexing points at which a winding machine places wires. The zero mark at the left of the horizontal axis represents the end of one quadrant and the beginning of the one shown, and the 41st mark at the right represents the end of the quadrant shown and the beginning of another. The angle in degrees of the portions is also indicated. Conductors lying on the zero axis are shown partially in solid and partially dotted, so as to indicate that portion of the conductor contributing to the field distribution in the quadrant in question. As illustrated, the conductors are separated vertically as well as horizontally but in practice they may be close-packed as required by practical winding considerations.

In FIG. 8, the wires illustrated are cross-sections of the wires of a single wire wound to form either toroidal or saddle type windings. Consequently, the same current flows through all the wires. FIGS. 8*a* and 8*b* illustrate the winding distribution near the exit end of the yoke. For this purpose, the exit end is at or near the end of the magnetic core. Wires 402 and 404 are located above the horizontal axis zero point which divides one quadrant from another in FIG. 8*a*. For purposes of analysis, each contributes one-half a unit of current and therefore one-half a turn to the quadrant shown, for a total of 1 turn. The first division or portion of the quadrant of FIG. 8*a* also includes a third wire 406, which lies entirely within the first division and therefore contributes a full turn. Contributions of turns are also provided by wires 407 and 408, which are illustrated as straddling the dividing line between the first and second portions of the quadrant. Consequently, wires 407 and 408 each contribute one-half turn, for a total of 1 turn contribution to the first division of the quadrant. Thus, the total turn contribution in the first division of quadrant of FIG. 8*a* is one-half unit each from wires 402, 404 407 and 408, and a 1-unit contribution from wire 406. Total turn contribution from those wires associated with the first division of quadrant thus totals 3 turns. FIG. 8*b* illustrates the total turn contribution in the first division of the quadrant as being 3.

The second division of the quadrant in FIG. 8*a* includes the contribution of one-half turn each from wires 407 and 408, and one-half turn each from wires 411 and 412, which straddle the division between the second and third divisions of the quadrant. The second quadrant also receives a full turn contribution from windings 409 and 410, for a total contribution of 4 turns, as illustrated in FIG. 8*b*. The third division of FIG. 8*a* also has a 4-turn contribution, and the fourth division through the eleventh division each have a 3-turn contribution. The twelfth division includes one-half unit contribution from each of windings 414 and 416, for a total contribution of 1 turn as illustrated in FIG. 8*b*. The remaining portions of the quadrant contain no conductors and the turn distribution is therefore zero. Thus, it can be seen that the turns distribution near the exit region of the actual yoke, as illustrated in FIG. 8*a*, may be represented by a discontinuous turn or winding density distribution function $W_h$ 420 as illustrated in FIG. 8*b*.

FIG. 8*c* illustrates the actual turns distribution in one quadrant of a yoke embodying the invention in the mid region intermediate the entrance and exit ends of the yoke. Distribution 440 in FIG. 8*d* is a corresponding winding density distribution ($W_h$) representing the net contribution of the windings shown in FIG. 8*c*. Similarly, the turns distribution illustrated in FIG. 8*e* represents the horizontal winding distribution near the entrance region of the same yoke embodying the invention as illustrated in FIGS. 8*a* and 8*c*. Distribution 460 of FIG. 8*f* represents the winding density distribution ($W_h$) of FIG. 8*e*.

The vertical winding distribution ($W_v$) of a yoke embodying the invention is shown in FIGS. 8*g*–8*m*. FIGS. 8*g*, 8*i* and 8*k* represent the actual winding distribution at the exit, mid and entrance ends of the yoke, respectively, and FIGS. 8*h*, 8*j* and 8*m* represent the corresponding winding density distributions ($W_v$) 470, 480 and 490. Comparison of FIGS. 8*a*–8*f* with FIGS. 7*a*–7*c* and FIGS. 8*g*–8*m* with FIGS. 7*d*–7*f* reveals that the FIG. 7 representation of the winding distribution is oversimplified for a winding distribution such as those shown, in that it omits important structural detail.

A mathematical characterization of the coils of a yoke is afforded by a Fourier expansion of the winding distribution as known and as described for example in U.S. Pat. No. 4,117,434 issued Sept. 26, 1978 to Logan. That is, at a particular cross-section of the yoke, the discrete winding distribution of the horizontal and vertical coils of the yokes embodying the invention can be described by Fourier series expansions of their respective winding densities:

$$w_H(\phi) = \sum_{1,3\ldots} C_n \cos n\phi \quad w_V(\phi) = \sum_{1,3\ldots} S_n \sin n\phi$$

where $C_n$, $S_n$ are the odd-order Fourier coefficients of the horizontal and vertical winding density distributions respectively, and $w(\phi)$ is the winding density distribution which means that $w(\phi)\,d\phi$ is the number of turns in the interval from $\phi$ to $\phi+d\phi$. The total number of turns N per quadrant (which is, of course, the same in all cross-sections) is given by $$N_H = \sum_{1,3\ldots} \frac{C_n}{n} \quad N_V = \sum_{1,3\ldots} \frac{S_n}{n}$$

Note that the centroid of the winding density distribution is defined by $$\overline{\phi}_H = \int \phi w_H d\phi / \int w_H d\phi$$

and the angle $\theta$ subtended between the centroids of the two halves of the coil is $\theta = \pi - 2\overline{\phi}_H$.

The coils of the XP75-125-CE 90° yoke, the winding distribution of which is illustrated in FIGS. 4–6, and the coils of similar 90° yokes embodying the invention may be described by the fundamental and third harmonics of their winding densities in three cross-sections (entrance, mid, exit portions). To render this characterization independent of the coil's impedance, the fundamental component is expressed as a fraction of the total number of turns in a quadrant and the third harmonic as a fraction of the fundamental.

The coefficients listed below represent the normalized coefficients of the fundamental and third harmonics of the winding distribution at the entrance, mid and exit regions of a 90° toroidal yoke (XP75-125-CE) embodying the invention. The horizontal winding distribution is approximated by the fundamental ($C_1/N_H$) and third-harmonic ($C_3/C_1$) components, and the vertical winding distribution is approximated by the fundamental ($S_1/N_V$) and third-harmonic ($S_3/S_1$) component.

| | XP75-125-CE | | | |
|---|---|---|---|---|
| | HORIZONTAL | | VERTICAL | |
| | $\frac{C_1}{N_H}$ | $\frac{C_3}{C_1}$ | $\frac{S_1}{N_V}$ | $\frac{S_3}{S_1}$ |
| entrance | 0.99 | −0.14 | 1.10 | −0.26 |
| mid | 1.11 | 0.23 | 0.95 | 0.14 |
| exit | 1.24 | 0.80 | 0.67 | 1.43 |

Figure 9:
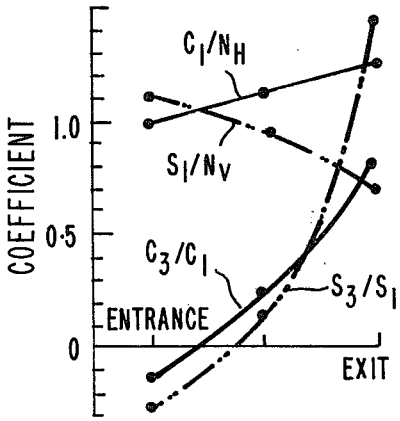

These Fourier coefficients are plotted in FIG. 9 at three axial positions (entrance, mid and exit regions) along the yoke.

Figure 10:
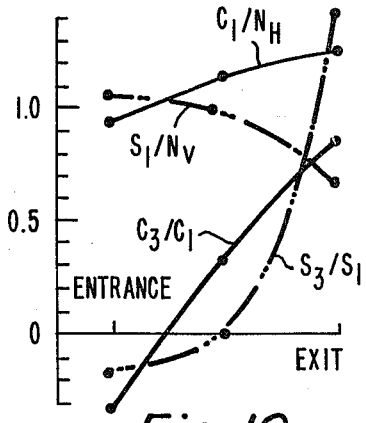
FIGS. 9 and 10 are plots of the value of normalized Fourier fundamental and third-harmonic coefficients as a function of longitudinal position along a yoke embodying the invention.

Similarly, for a toroidal 110° yoke (XP75-128-ECQ) embodying the invention, the coils are characterized by the coefficients:

| | XP75-128-ECQ | | | |
|---|---|---|---|---|
| | HORIZONTAL | | VERTICAL | |
| | $\frac{C_1}{N_H}$ | $\frac{C_3}{C_1}$ | $\frac{S_1}{N_V}$ | $\frac{S_3}{S_1}$ |
| entrance | 0.94 | −0.34 | 1.04 | −0.17 |
| mid | 1.14 | 0.33 | 0.99 | 0 |
| exit | 1.25 | 0.87 | 0.69 | 1.42 |

which are plotted in FIG. 10.

Yokes according to the invention have horizontal coils whose winding distributions are characterized by a fundamental Fourier component $C_1/N_H$ of their winding density normalized to the total number of turns per quadrant that increases from entrance to exit of the yoke, and by a third-harmonic Fourier component $C_3/C_1$ normalized to the fundamental that has a negative value at the entrance of the yoke, turns positive before or at the mid region, and has its largest positive value near the exit of the yoke; and vertical coils whose winding distributions are characterized by a normalized fundamental Fourier component $S_1/N_H$ that decreases from entrance to exit of the yoke, and by a normalized third harmonic component $S_3/S_1$ that has a negative value at the entrance of the yoke, turns positive before or at the mid region, and has its largest positive value near the exit of the yoke.

The measured sensitivity of convergence of these yokes (mm/mm) is as follows:

| | HORIZ. MOTION | | VERT. MOTION | |
|---|---|---|---|---|
| | Width Error | Height Error | Horiz. Crossover | Vert. Crossover |
| XP75-125-CE (19V 90°) | 0 | 0.1 | 0.1 | 0 |
| XP75-128-ECQ (25V 110°) | 0.1 | 0.1 | 0.3 | 0.3 |

which is substantially insensitive. For practical purposes, a horizontal deflection winding may be said to have convergence insensitive to motion if transverse horizontal motion of the yoke or a corresponding tilt of the yoke relative to the electron beams in the kinescope causes vertical crosshatch lines scanned by the two offset beams at each side of the raster of move horizontally relative to each other (size change) less than 0.4 mm per mm of motion, and vertical motion of the yoke relative to the beams causes the ends of horizontal lines scanned by the offset beams through the center of the raster to move vertically relative to each other less than 0.4 mm/mm. Similarly, a vertical deflection winding may be said to be insensitive if horizontal motion of the yoke relative to the beam causes horizontal crosshatch lines scanned by the two offset beams at the top and at the bottom of the raster to move vertically relative to each other less than 0.4 mm per mm of motion, and vertical motion of the yoke causes the ends of vertical lines scanned by the offset beams through the center of the raster to move horizontally relative to each other less than 0.4 mm/mm.

Saddle-type yokes may also be characterized by Fourier coefficients. The quasi-continuous winding distributions of saddle coils in one quadrant of a yoke may be described by Fourier series expansion of their radial thickness in a constant-z plane representing one cross-section of the winding.

$T(\phi) = \Sigma C_n \cos n\,\phi$, where $T(\phi)$ is the thickness varying with the angle $\phi$ at any cross-section, and $C_n$ is the Fourier coefficient of order n. The area A of any cross-section perpendicular to the inner contour R(z) of the saddle coil is constant, because the total number of wires is the same at all cross-sections, and is given, to within $(T)^2 < R$, by $$A = \frac{R}{\sqrt{1+R'^2}} \sum_{1,3\ldots} \frac{C_n}{N}$$

where R is the inner radius of the horizontal saddle coil at the cross-section in question, $R' = dR/dz$, and z is axial distance.

The horizontal saddle coils are characterized by the fundamental and third harmonic Fourier coefficients of their radial thickness in three defining cross-sections. Again, to normalize for impedance, the fundamental component of the cross-sectional area is expressed as a fraction of the total cross-section, corresponding to normalization to the number or quantity of windings, and the third harmonic coefficient is expressed as a fraction of the fundamental.

Other embodiments of the invention will be apparent to those skilled in the art. In particular, described insensitive vertical windings may be used individually together with sensitive horizontal windings, and the insensitive windings may be used in a yoke which is not snug-fitting.

What is claimed is:

1. A color television display apparatus, comprising:

a kinescope including an electron gun assembly for producing three in-line electron beams; and a deflection yoke mounted upon said kinescope, said yoke including entrance and exit ends and also including horizontal deflection conductors in a distribution about said kinescope, said distribution of horizontal deflection conductors being described in a quadrant by horizontal fundamental Fourier coefficients normalized to the quantity of said horizontal deflection conductors in said quadrant, which normalized horizontal fundamental Fourier coefficients increase in value from said entrance end to reach a maximum value near said exit end of said yoke, said distribution of said horizontal conductors also being described in said quadrant by horizontal third-harmonic Fourier coefficients normalized to said horizontal fundamental coefficients at each longitudinal position at which said horizontal third-harmonic coefficients are established, said horizontal third-harmonic coefficients having a negative value near the entrance-end of said yoke, and having a value which becomes increasingly positive at positions towards the mid region of said yoke so as to take on a positive value near said mid region, and having a maximum positive value near said exit region; said deflection yoke also including vertical deflection conductors in a distribution about said kinescope, said vertical distribution being described in a quadrant by vertical fundamental Fourier coefficients normalized to the quantity of said vertical conductors in said quadrant, which normalized vertical fundamental Fourier coefficients decrease in value from said entrance to said exit regions to reach a minimum value near said exit end of said yoke, said distribution of said vertical conductors also being described in said quadrant by vertical third-harmonic Fourier coefficients normalized to the value taken by said vertical fundamental Fourier coefficient at each longitudinal position at which said vertical third-harmonic Fourier coefficients are established, said vertical third-harmonic Fourier coefficients having values which are negative near said entrance-region of said yoke, and which values take on increasingly more positive values at positions toward said mid region of said yoke, and having a maximum positive value near said exit region, whereby the convergence of said color display apparatus is rendered substantially insensitive to the transverse position of said yoke relative to said kinescope.

2. A color television display apparatus, comprising:

a kinescope including an electron gun assembly for producing three in-line electron beams; and a self-converging and motion insensitive deflection yoke mounted on said kinescope for passage therethrough by said electron beams, the passage of the electrons of said electron beams defining beam entrance and beam exit ends of said yoke which in turn are on either side of a mid-region of said yoke, said yoke comprising horizontal and vertical deflection windings formed from turns of conductors, said turns of conductors being wound to form distributions of conductors which vary from said entrance to said exit ends of said yoke, said distributions at any particular cross-section of said yoke taken perpendicular to the direction of said beams having axes of symmetry whereby the entire distribution at said particular cross-section can be substantially defined by describing the conductor distribution within one quadrant of said cross-section, said conductor distributions being definable within any said quadrant in terms of the sum of normalized fundamental and normalized third-harmonic Fourier coefficients, said fundamental Fourier coefficients being normalized by dividing by the total number of windings for making the Fourier representation independent of the total number of windings and therefore independent of the impedance of the windings, said fundamental Fourier coefficients being representative of a conductor distribution which is a maximum at one end of a quadrant and zero at the other end, said third-harmonic Fourier coefficients being normalized by dividing by the maximum value of said fundamental Fourier coefficient for maintaining the representation independent of the number of windings and the impedance of the windings; said third-harmonic Fourier coefficients being representative of a conductor distribution which is maximum at said one end of said quadrant at which said fundamental Fourier coefficient is a maximum, and a minimum at said other end of said quadrant, said distribution of horizontal deflection conductors of said yoke being described in a quadrant by the sum of normalized fundamental and third-harmonic horizontal Fourier coefficients, said normalized fundamental horizontal Fourier coefficients increasing in value from cross-sections taken near said entrance end to reach a maximum value at said exit end of said yoke, said normalized third-harmonic horizontal Fourier coefficients having a negative value at cross-sections taken near the entrance end of said yoke and having a value which becomes increasingly more positive at cross-sections taken towards the mid-region of said yoke so as to take on a positive value near said mid-region, and having a maximum positive value at cross-sections taken near said exit region whereby the distribution of conductors of said horizontal deflection winding is densely packed and subtends a relatively small portion of said quadrant at cross-sections taken near said exit end, and is progressively less densely packed and subtends a relatively greater portion of each quadrant at cross-sections taken progressively closer to said entrance end of said yoke;

said vertical deflection conductors being described in a quadrant by the sum of normalized fundamental and third-harmonic vertical Fourier coefficients, said vertical fundamental Fourier coefficients having a value at cross-sections taken near said entrance end of said yoke and progressively decreasing in value at cross-sections taken progressively closer to said exit-end of said yoke, said normalized vertical third-harmonic Fourier coefficients having values which are negative at cross-sections taken near said entrance end of said yoke and which values become increasingly more positive at cross-sections taken at positions progressively nearer the mid-region of said yoke, and having maximum positive values at cross-section taken near said exit-region of said yoke, whereby said vertical winding exhibits a distribution in a quadrant which distribution has the greatest density near one end of the quadrant at cross-sections taken near said entrance end of said yoke which greatest density progressively shifts toward the other end of said quadrant at cross-sections taken progressively nearer said exit region of said yoke;

whereby the convergence of said color display apparatus is rendered substantially insensitive to the transverse position of said yoke relative to said kinescope.

* * * * *